US005977529A

United States Patent [19]

Willert-Porada et al.

[11] Patent Number: 5,977,529

[45] Date of Patent: Nov. 2, 1999

[54] METHOD, DEVICE FOR THE HEAT TREATMENT OF MATERIALS IN A MICROWAVE OVEN AND USE OF THIS METHOD AND DEVICE

[75] Inventors: Monika Willert-Porada; Thorsten Gerdes, both of Dortmund; Klaus Rödiger, Bochum, all of Germany

[73] Assignee: Widia GmbH, Essen, Germany

[21] Appl. No.: 08/930,975

[22] PCT Filed: Mar. 21, 1996

[86] PCT No.: PCT/DE96/00536

§ 371 Date: Oct. 9, 1997

§ 102(e) Date: Oct. 9, 1997

[87] PCT Pub. No.: WO96/34513

PCT Pub. Date: Oct. 31, 1990

[30] Foreign Application Priority Data

Apr. 26, 1995 [DE] Germany ..... 195 15 342

[51] Int. Cl.[6] ..... H05B 6/78

[52] U.S. Cl. ..... 219/698; 219/752; 219/753

[58] Field of Search ..... 219/690, 691, 219/693, 695, 696, 697, 698, 700, 701, 745, 746, 750, 752, 753, 754, 762

[56] References Cited

U.S. PATENT DOCUMENTS

| | | |
|---|---|---|
| 3,100,106 | 8/1963 | Bielenberg et al. . |
| 4,808,782 | 2/1989 | Nakagawa et al. . |
| 5,250,773 | 10/1993 | Lind et al. . |
| 5,266,762 | 11/1993 | Hoffman et al. . |

FOREIGN PATENT DOCUMENTS

| | | |
|---|---|---|
| 0 136 453 B1 | 4/1985 | European Pat. Off. . |
| 2 548 507 A1 | 1/1985 | France . |
| 1 123 064 | 2/1962 | Germany . |
| 18 13 554 | 8/1969 | Germany . |
| 1 935 681 | 2/1971 | Germany . |
| 19 47 738 | 4/1971 | Germany . |
| 25 54 422 C2 | 6/1976 | Germany . |
| 36 43 649 A1 | 6/1988 | Germany . |
| 38 18 490 C2 | 12/1989 | Germany . |
| 39 26 471 A1 | 2/1991 | Germany . |
| 41 36 416 A1 | 5/1993 | Germany . |
| 43 24 635 A1 | 1/1995 | Germany . |
| 43 24 606 A1 | 2/1995 | Germany . |

*Primary Examiner*—Tu Ba Hoang
*Attorney, Agent, or Firm*—Herbert Dubno

[57] ABSTRACT

A method and apparatus for the heat treatment of hard metals, cermets and ceramics in a microwave sintering furnace, the material to be treated being moved together with the resonator relative to one or a plurality of microwave sources. The material to be treated is disposed in individual cassettes which, with the exception of an opening necessary for the microwave radiation, consist of material which is impermeable to microwaves and dimensioned to simultaneously form microwave resonant cavities at a microwave frequency when charged with the material.

19 Claims, 2 Drawing Sheets

METHOD, DEVICE FOR THE HEAT TREATMENT OF MATERIALS IN A MICROWAVE OVEN AND USE OF THIS METHOD AND DEVICE

CROSS REFERENCE TO RELATED APPLICATIONS

This application is a national stage of PCT/DE96/00536 filed Mar. 21, 1996 and based, in turn, upon German National Application 195 15 342.1 of Apr. 26, 1995 under the International Convention.

FIELD OF THE INVENTION

The invention relates to a method for the heat treatment of materials, particularly of powders, hard metals, cermets and/or ceramic in which the articles to be treated are moved relative to one or more microwave sources.

Further the invention relates to a device for the heat treatment of hard metals, cermets and/or ceramics with a microwave sintering oven.

BACKGROUND OF THE INVENTION

DE 43 24 635 A1 describes microwave chamber ovens which are equipped for the batch sintering of ceramic bodies at temperatures up to approximately 1650° C. Tunnel furnaces with conventional heating for continuous sintering are known, but they have proven to be energy consuming and time consuming. In order to alleviate this situation, a sintering installation has been proposed which comprises at least one stationary sintering table whereupon the bodies to be sintered can be placed, and at least one microwave source in a tunnel-shaped traveling hood, which can be moved by a drive over the sintering table. The hood is made in a self-supporting manner of metal, for instance aluminum. In a concrete example in or on the hood several microwave sources are provided, which are connected with a measuring, control and adjustment unit for the purpose of a temperature-controlled adjustment of the microwave output and/or of the hood speed. The ceramic bodies to be sintered can be arranged in a microwave-transparent and heat-insulated cassette, which for instance is made of aluminum oxide fiber.

DE 36 43 649 A1 also describes a device for the continuous heating of polar, especially temperature-sensitive goods or highly viscous products under simultaneous application of microwave energy and conditioned atmosphere, whereby the goods to be treated traverse a sufficiently dimensioned resonator chamber more than once in alternating directions. The transport of the goods through the device can be done optionally with the assistance of conveyor belts, troughs, spirals or pipes, with or without additional vibration, optionally with underpressure, normal pressure or overpressure. By increasing the resonance chamber, such a device should provide a more uniform field distribution, however any solid coupling of a test sample of hard metal, cermet or ceramic subjected to the heat of the microwave, modified the field distribution uncontrollably, especially then, when according to DE 36 43 649 A1, the pieces assume more or less randomly arranged positions when they fall from one conveyor belt unto the next.

DE 41 36 416 A1 proposes a device for the microwave treatment of materials, particularly starting materials for ceramic materials, alloys, etc. with a conveyor segment, which is defined at least sectionally by trough or pipe arrangements, whose walls have a certain microwave-absorption capability. This device has a resonator surrounding the wall at least sectionally, as well as at least one generator for producing microwave radiation, whereby the walls of the through or pipe arrangement have a microwave-absorption capability which varies over their length. For the purpose of directly heating the materials with microwaves, it is possible to precede the conveyor segment with an additional device, by means of which additives with high microwave-absorption capability are added to the materials. However this device is limited to the treatment of such materials which can be processed by an extruder or can be fed via a screw transporter.

DE 39 26 471 A1 describes a method for the heat treatment of organic substance mixtures, whereby the exposure to microwaves takes place within a resonance chamber which basically is reflectively limited on all sides, wherein a mode and frequency splitting of the microwave takes place and whose main dimensions do not fall below approximately eight times the free space wavelength of the microwave field in relation to the nominal frequency. Besides the fact that in this reference the treatment of hard metals, cermets and/or ceramics is not even mentioned, the expensive manufacturing techniques and required apparatus for the sintering treatment would be uneconomical in view of the low throughput.

OBJECTS OF THE INVENTION

It is the object of the present invention to provide a method and a device of the kind mentioned in the introduction, wherein a uniform heat distribution is achieved in all goods to be heated. The method should, according to another object, be as continuous and economically feasible as possible, whereby a treatment in steps of the bodies to be treated can be performed economically at different temperature levels with the lowest possible constructive effort.

According to the invention the goods to be treated are arranged in individual cassettes, which except for a passage opening necessary for the microwave radiation, form at the same time the resonance chamber. The cassettes do not exceed a length, height and/or width of preferably 6 wavelengths at 2.45 GHz (in a medium $\epsilon_r$=1 or in vacuum) of the used microwave radiation. Thus a multimode resonator is created, whose size corresponds maximally only to a few wavelengths of the used microwave radiation, so that in relation to the used microwave length the components of the charge act as mode mixers, which contribute to the multiple reflection of the microwave.

The distribution of the goods to be sintered in individual cassettes, which at the same time define the cavity, makes possible a sintering in a quasi-continuous process, which can be controlled analogously to conventional tunnel furnaces. By charging the cassettes with treatment goods (presintering products) the homogeneity of the field is preserved in corresponding measure. While the opinion in the art is that the field can be made uniform as a result of the increase the resonator size, tests have proven that the field distribution is essentially influenced by the charge. This makes it difficult to calculate the respective oven space, since each charge of a different kind will result in a different field distribution.

The present invention inclines towards small cassettes acting as resonators and which meet the conditions specified. A row of cassettes can thus travel underneath a row of microwave sources, and the radiation output of each of the microwave sources can be tuned to the temperature level desired in this cassettes. This way it becomes possible for instance to perform heating, holding or cooling phases successively and next to each other.

According to a further development of the method the individual cassettes are transported in a row through a tunnel provided with magnetrons, so that each cassette is successively irradiated by the magnetrons. Thereby it is possible to have continuous or discontinuous movement of the cassettes in any direction with respect to the microwave sources.

A further increase in flexibility is possible when the cassettes have at least one slidable lateral wall, which prior to the heat treatment is adjusted to the filling degree of the goods to be treated and to the irradiated microwave length. Hence it is possible for instance to take into consideration the resonance space when adjusting it to the charge amount. The principle of a sliding lateral wall, respectively of a corresponding piston, is explained and represented in E 0 234 528 A1, FIG. 8. This system can also be used here in the case of the multimode cassettes.

According to the invention, several cassettes filled with goods to be treated are arranged in the microwave sintering oven. Except for an opening necessary for the passage of the microwave radiation, the cassettes have walls which are essentially not microwave permeable, and which further corresponding to the kind of material and the load, have a length, width and/or height which without charge lead to the formation of discrete modes. The cassettes have a length, width and/or height which in the uncharged state are too small to produce a continuous energy distribution at the used microwave length, but which in the charged state make possible a homogeneous heating and preferably do not exceed 6 wavelengths of the used microwave radiation. Each cassette constitutes a microwave resonance chamber.

The sintering furnace can be built as a tunnel with stationary microwave sources, through which the cassettes travel longitudinally, for instance by means of a conveyor belt. Depending on the temperature and/or the sintering furnace atmosphere, the cassette walls are preferably made of a microwave-reflecting material, preferably graphite, steel, molybdenum, nickel, titanium, tantal, copper, aluminum and/or alloys. As already mentioned, at least one cassette wall can be slidable on the bottom, in order to tune the resonator or to enlarge it or reduce it.

According to a further embodiment of the invention, the tunnel has several microwave sources arranged at a distance from one another which corresponds approximately to the cassette length and preferably exceeds the latter by the width of the waveguide. Therefore in the batch mode processing of the cassette row in the microwave tunnel, each cassette can be exposed to one microwave source, so that it becomes possible to individually adjust the radiation output and the temperature for each cassette.

According to yet another embodiment of the invention, shielding walls which are not permeable to microwave are arranged in the tunnel laterally of each microwave source, preferably at a distance which roughly corresponds to the cassette length. This insures that the microwave radiation is laterally shielded, thus being advantageously directed to the respective cassette which at the moment is underneath the source.

In the simplest case, the cassettes are open at the top or have a microwave permeable lid. This latter arrangement has the advantage that the cassette can be built as a closed space.

In the simplest case the cassettes have a rectangular shape. However they can also have more complex shapes—depending on the microwave, sintering or heating technique—such as polygonal or cylindrical shapes.

In order to make it possible to adjust and control also the individual cassette atmosphere, each cassette has at least one connection piece closable by a valve, through which gas can be supplied or evacuated. In this way it is possible to build up an atmosphere of protective gas in the cassette.

Advantageously the cassettes can be conveyed through the tunnel such that the upper edge of their lateral walls can pass at the shortest possible distance underneath the lower edge of the vertical shielding walls on the side of the microwave sources. In this way an optimal shielding is insured, i.e. it becomes impossible for the microwave fields of two neighboring sources to overlap.

Furthermore the tunnel advantageously has sections where the heating differences can be considerable, as required during sintering.

In a first section with temperatures up to 600° C., preferably 200° C. to 500° C., sintering bodies can be dewaxed, for which purpose corresponding suction devices are provided; the sintering section should be heatable to temperatures between 400° C. and 1800° C., preferably 600° C. to 1400° C., the cooling section can be only slightly heated or not at all. Optionally a rinsing with a protective gas, inert gas, reactive gas and/or gas mixture can be provided.

Furthermore individual zones of the furnace can also be heated conventionally or the microwave treatment of the goods can be limited only to individual process steps.

The process and/or the device can also be used for the synthesis of tungsten carbide, but also for separate heat treatments alone, such as dewaxing of components.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
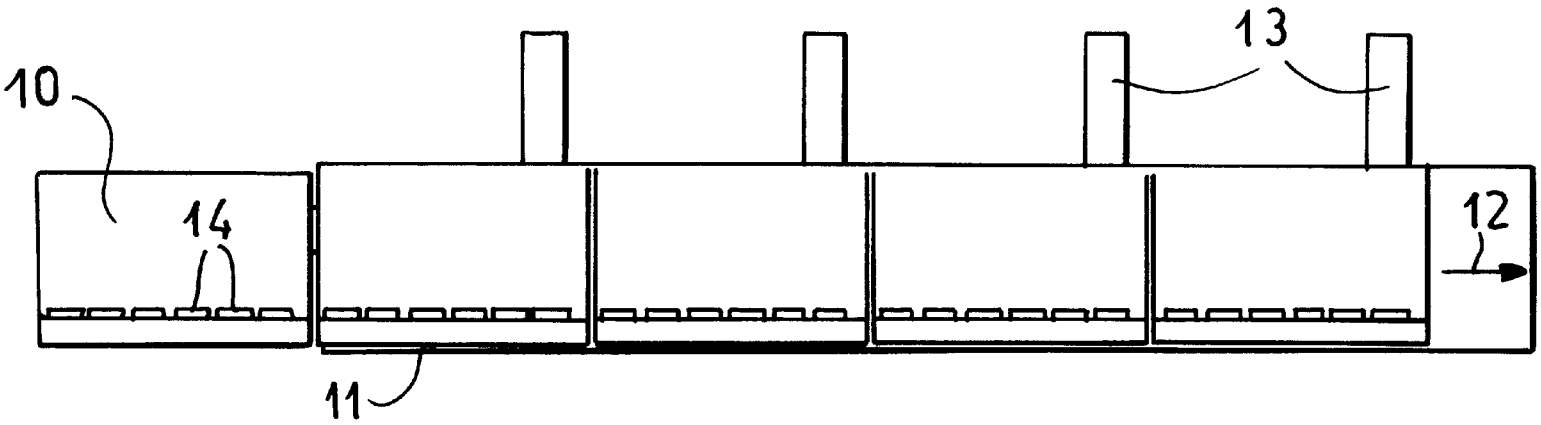
FIGS. 1 and 2 are schematic side views of rows of five cassettes in various relative positions with respect to the microwave sources and FIG. 3 is a similar view of an alternative construction of the microwave tunnel furnace.
Figure 2:
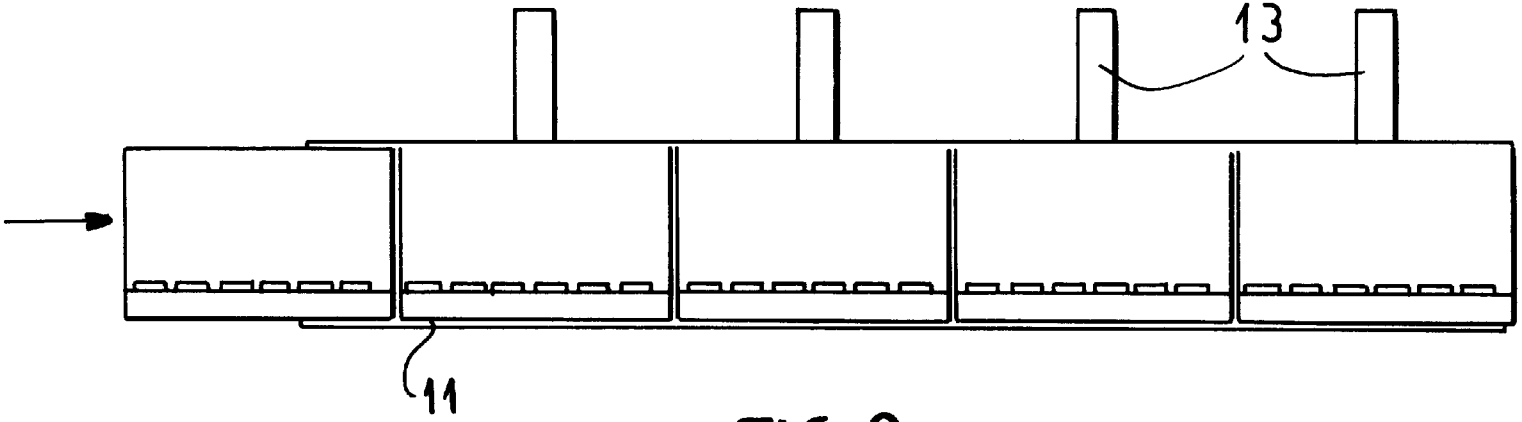

As can be seen from FIGS. 1 and 2, the goods to be sintered are distributed to individual cassettes 10, arranged in a row one after the other, traversing a tunnel 11 in the direction of arrow 12. In the tunnel 11 microwave sources 13 (magnetrons) are arranged at equal intervals, the rows of cassettes being passed under them. The cassettes are filled with treatment goods, here prepressed cutting plates 14 made of hard metal, cermet or ceramic. The different output densities or irradiation outputs of the microwave sources 13 are made recognizable by differences in the shading of the cassette. In the present case, the last source 13 has the strongest output, so that the treatment goods 14 are increasingly heated in its advancing motion from left to right.

In FIG. 2 the same row of cassettes is shown after a certain advance. In the position shown in FIG. 2, each microwave source 13 is centrally positioned above the respective cassette 10. The cassettes are connected electrically with the tunnel wall relative to the microwave sources 13, preferably through sliding contacts.

Figure 3:
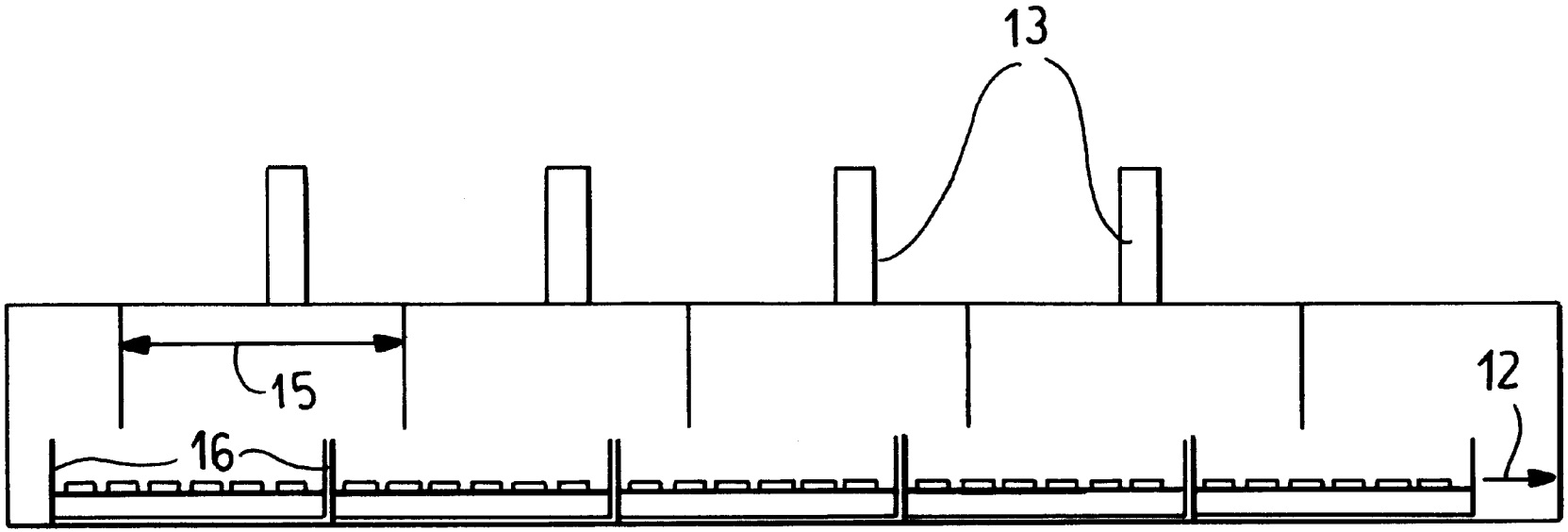

In the embodiment of FIG. 3 additional shielding walls 15 are provided, whose lower edges end closely above the upper edge of the lateral walls 16. This insures that the cassettes 10, in a centered position underneath the respective magnetron 13, are exposed exclusively to its radiation. In this position field overlapping caused by the microwave radiation of neighboring sources are excluded, in all other positions they are possible.

The cassettes 10 can either be open at the top or have a microwave-permeable lids. The lateral walls and the bottom consist of a microwave-impermeable material. Because of the distribution of the goods to be sintered in small cassettes, which at the same time represent the so-called cavity, the sintering becomes a quasi-continuous process, which can be controlled analogously to conventional tunnel furnaces. The dimensions of the sintering boxes are tuned to the microwave radiation, whereby through a uniform charging an optimal field homogeneity is insured. This field homogeneity does not depend on the throughput, since the latter is determined by the conveying speed of the cassettes 10. Due to the segmentation of the tunnel in sections of identical construction, each of them representing closed resonators with separate microwave sources 13, the flexibility of the process can be enhanced. So for instance it is possible to establish different temperature zones just like heating and cooling, based on fewer sintering units to be advanced. In this way the entire sintering cycle can be carried out in approximately 2 hours. Longer cooling times, such as are required with bigger charges in traditional microwave ovens, are completely eliminated.

For the dewaxing of the components, several cassettes 10, loaded in one layer with a charges of wax-containing hard metal indexable inserts at a distance of approximately 33 mm from each other, are passed at a speed of <20 $cmMin^{-1}$ through the tunnel subjected to microwaves of the frequency 2.45 GHz and with increasing power density. The maximum temperature reached amounts to 500° C. The evaporating wax is continuously withdrawn through openings in the tunnel ceiling. The samples dewaxed this way are subsequently directed either to a conventionally or microwave-heated sintering oven.

For the heat treatment of pressed tungsten carbide bodies with high porosity, several graphite cassettes 10 of the size 50×50×30 $cm^3$, each charged with several pressed tablets of high porosity, consisting of an intimate mixture of tungsten and carbon powders, are passed with a speed of <10 $cmMin^{-1}$ through the tunnel subjected to microwaves of the frequency 2.45 GHz and with variable power output. The mixture is converted into tungsten carbide powder due to microwave dissipation, at temperatures between 1000 to 1800° C.

What is claimed is:

1. A method of heat treating articles composed of at least one material selected from the group which consists of powders, hard metals, cermets and ceramics, comprising the steps of:

(a) providing a plurality of cassettes having microwave-impermeable walls and each formed with an opening enabling microwave energy to pass into said cassettes, said cassettes being dimensioned when charged with said articles to form microwave-resonant cavities at a microwave frequency;

(b) charging said cassettes with said articles; and (c) relatively displacing said cassettes charged with said articles and a plurality of spaced-apart microwave sources of substantially said microwave frequency so that each of said cassettes is energized by a succession of said sources and articles in said cassettes are heated by microwave energy therein.

2. The method defined in claim 1 wherein said cassettes have a length, height or width not in excess of six wavelengths of said microwave frequency.

3. The method defined in claim 2 wherein, in step (c) said cassettes are moved in a row through tunnel equipped with spaced apart magnetrons forming said sources.

4. The method defined in claim 2 further comprising the step of adjusting a geometry of each of said cassettes with respect to the degree of filling thereof with said articles and the type of said articles prior to relatively displacing said cassettes and said sources.

5. The method defined in claim 4 wherein the geometry of each cassette is adjusted by movement of a slidable cassette wall.

6. An apparatus for heat treating articles comprised of at least one material selected from the group which consists of powders, hard metals, cermets and ceramics which comprise:

a plurality of cassettes having microwave-impermeable walls and each formed with an opening enabling microwave energy to pass into said cassettes, said cassettes being dimensioned when charged with said articles to form microwave-resonant cavities at a microwave frequency;

a microwave sintering oven having a plurality of spaced apart microwave sources of substantially said microwave frequency and receiving said cassettes so that each of said cassettes is energized by a succession of said sources and articles in said cassettes are heated by microwave energy therein; and means for relatively displacing said cassettes and said sources.

7. The apparatus as defined in claim 6 wherein said cassettes have lengths, widths and heights which do not exceed six wavelengths of said microwave frequency and said oven is a tunnel equipped with spaced apart magnetrons forming said sources and through which the cassettes are longitudinally movable.

8. The apparatus as defined in claim 7 wherein said means for relatively displacing said cassettes and said sources includes a conveyor belt running through said tunnel.

9. The apparatus as defined in claim 7 wherein said walls are composed of at least one material selected from the group which consists of graphite, steel, molybdenum, nickel, titanium, tantalum, copper, aluminum and alloys thereof.

10. The apparatus as defined in claim 7 wherein each of said cassettes has at least one slidable cassette wall adjustable to alter geometry of the respective cassette.

11. The apparatus as defined in claim 10 wherein said magnetrons are spaced apart at a distance in excess of the length of the cassettes.

12. The apparatus as defined in claim 10 further comprising vertical shielding walls laterally of each of said magnetrons at intervals roughly corresponding to lengths of said cassettes.

13. The apparatus as defined in claim 7 wherein said cassettes are open at tops thereof.

14. The apparatus as defined in claim 7 wherein said cassettes have microwave permeable lids.

15. The apparatus as defined in claim 7 wherein said cassettes are formed with connection fittings for gas flow.

16. The apparatus as defined in claim 12 wherein said cassettes are positioned so that upper edges of lateral walls of said cassettes pass below lower edges of said vertical shielding walls at a minimum distance.

17. The apparatus as defined in claim 7 wherein said tunnel has sections including temperature zone up to 600° C. for dewaxing with suction, a sintering zone with 600° C. and 1400° C., and a cooling zone which can be flushed with a protective or inert gas.

18. A method of synthesizing tungsten carbide which comprises the steps of:

(a) providing a plurality of cassettes having microwave-impermeable walls and each formed with an opening enabling microwave energy to pass into said cassettes, said cassettes being dimensioned when charged with articles to form microwave-resonant cavities at a microwave frequency;

(b) charging said cassettes with a plurality of pressed articles containing tungsten and carbon particles;

(c) thereby synthesizing tungsten carbide from the tungsten and carbon of said articles.

19. A method of operating the apparatus defined in claim 7 wherein said articles consists of a composition containing tungsten and carbon powders for the synthesis of tungsten carbide.

* * * * *